United States Patent [19]

Fricke

[11] 4,062,155

[45] * Dec. 13, 1977

[54] SPARK PLUG CLEANER

[75] Inventor: Roy A. Fricke, River Forest, Ill.

[73] Assignee: Wells Manufacturing Corporation, Fond du Lac, Wis.

[ * ] Notice: The portion of the term of this patent subsequent to Mar. 11, 1992, has been disclaimed.

[21] Appl. No.: 645,268

[22] Filed: Dec. 29, 1975

[51] Int. Cl.[2] ..... B24C 3/00

[52] U.S. Cl. ..... 51/412; 51/433

[58] Field of Search ..... 51/8 SP, 9, 13, 433, 51/412

[56] References Cited

U.S. PATENT DOCUMENTS

| | | | |
|---|---|---|---|
| 2,554,858 | 5/1951 | Gogel | 51/8 SP |
| 3,008,274 | 11/1961 | Welter | 51/13 |
| 3,868,790 | 3/1975 | Fricke | 51/9 |

FOREIGN PATENT DOCUMENTS

| | | | |
|---|---|---|---|
| 773,061 | 4/1957 | United Kingdom | 51/8 SP |

*Primary Examiner*—James L. Jones, Jr.
*Assistant Examiner*—James G. Smith
*Attorney, Agent, or Firm*—John A. Dienner

[57] ABSTRACT

The present invention provides a compact, completely enclosed motor driven spark plug cleaner. It is preferably battery driven and is adapted to be held in the hand of the user. The invention provides a device for projecting granular abrasive against the electrodes and the insulation of a spark plug to clean them of carbon deposit. Safety features prevent projection of the abrasive particles into the face and particularly the eyes of the operator. Spark plugs of various sizes and screw threads may be treated without requiring any structural adjustments by the operator. The blast of abrasive particles is directed against the electrodes or "points" of the spark plug at an angle to the longitudinal axis of the plug, and the plug can be rotated and wobbled in its mount. This provides a novel and advantageous mode of operation and constitutes a novel method of cleaning a spark plug.

8 Claims, 10 Drawing Figures

Fig. 5
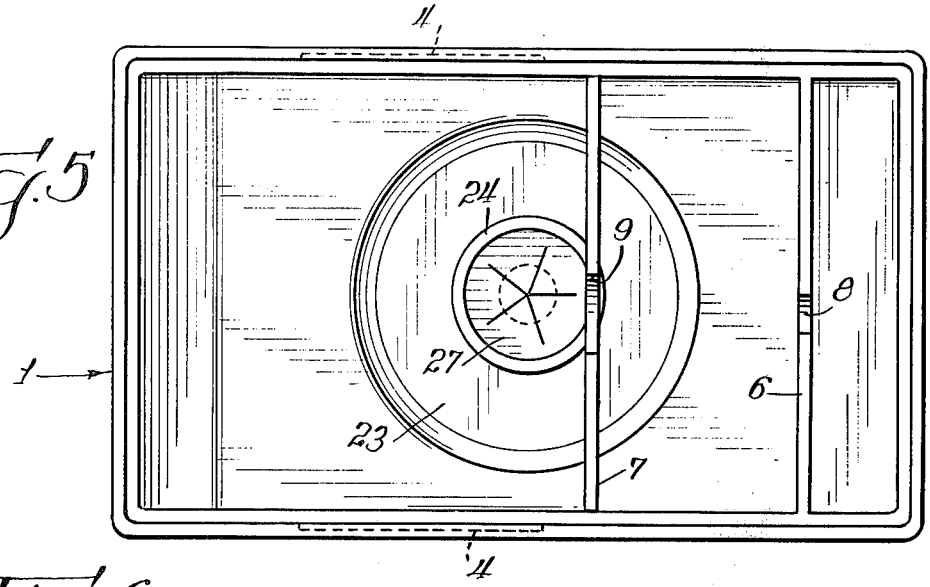
Fig. 6.
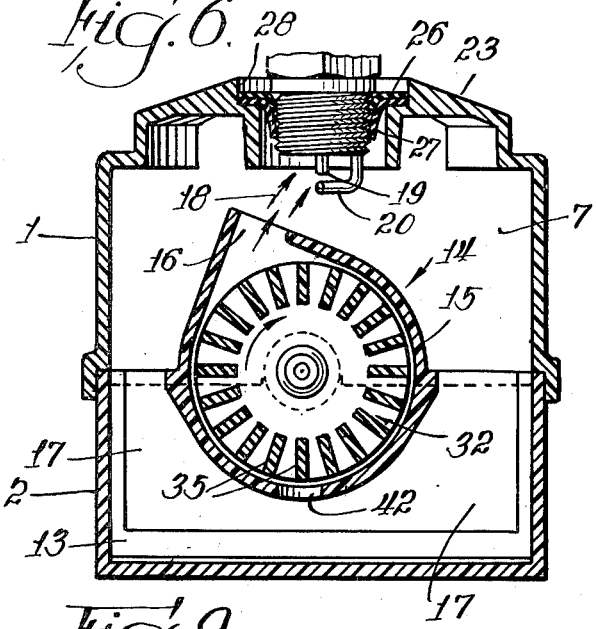
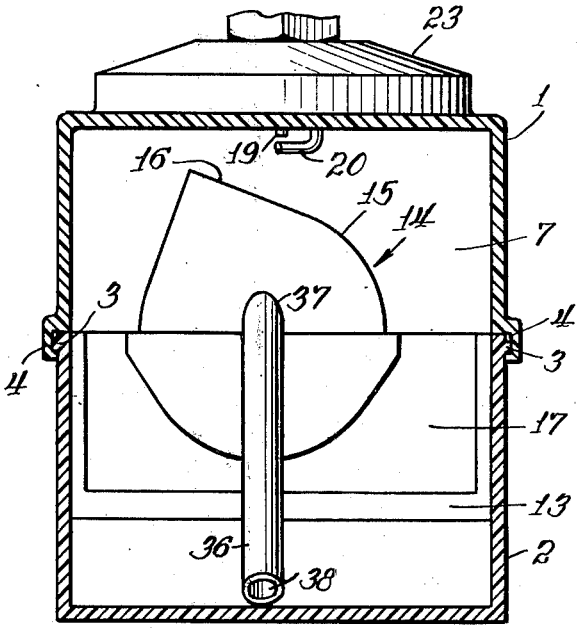
Fig. 7.
Fig. 9.
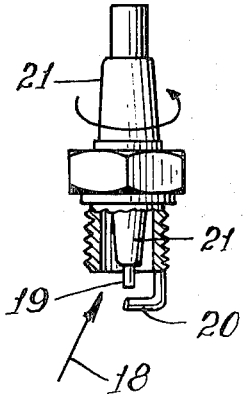
Fig. 8.
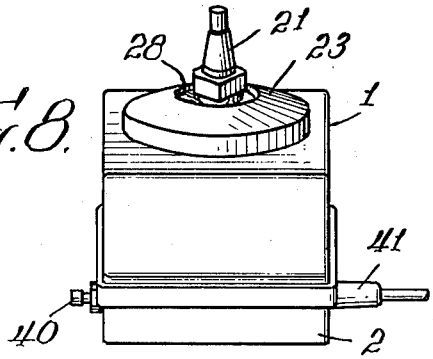
Fig. 10.
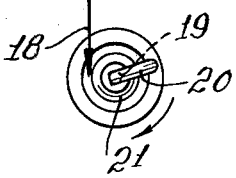

SPARK PLUG CLEANER

CROSS REFERENCE

The present invention is in the same field of use as that of my prior U.S. Pat. No. 3,868,790, but differs therefrom in the structure and mode of operation.

BRIEF SUMMARY OF THE INVENTION

The cleaner is driven by the battery current of an automobile through a suitable pair of extension cords equipped with spring clips. The device is small enough to be held in the hand of the user during operation of the device. It takes up little room in the tool compartment and is totally enclosed and portable and carries a charge of abrasive particles. It is constructed to be inherently safe—that is, it cannot accidentally expel the abrasive into the face or eyes of the operator, or outside the enclosing casing as, for example, through the opening which receives the spark plug to be cleaned.

Provision is made for cleaning spark plugs of different screw threads and of different sizes without opening the casing of the device which might entail loss of the abrasive or injury to the operator. The closing of the motor circuit switch is effected by the thumb of the operator grasping the device and the circuit is automatically opened upon the switch being released.

The aforesaid elastic seal for the threaded barrel of the spark plug permits spark plugs of different sizes and different threads to be held in place and cleaned.

OBJECTS OF THE INVENTION

The chief object of the invention is to provide a structure and mode of operation of a device of this class with the ability to clean plugs of various sizes and threads with safety to the operator and conservation of the abrasive to the loss of which devices of the prior art are subject.

A further object of the invention is to provide a spark plug cleaner which will clean the interior walls of the spark plug (as well as the exposed electrodes) by the diagonal discharge of the particulate relative to the longitudinal axis of the plug and the movability of the plug being cleaned, without allowing escape of the particulate. The ability of the spark plug when held in an elastic grip in a sealed condition to have a degree of rockable and wobble motion relative to the blast of particulate, and the diagonal line of discharge of the stream of particulate relative to the longitudinal axis of the plug provide a new capability in directing the abrasive upon the entire inner surfaces of the plug which may have become fouled with carbon deposit.

A further object of the invention is to provide a spark plug cleaner which permits the plug which is under treatment to be withdrawn for inspection and replaced in cleaning position, without opening the housing or casing of the device and without significant loss of particulate or injury to the operator.

BRIEF DESCRIPTION OF THE FIGURES OF THE DRAWING

FIG. 5 is a bottom plan view of the inside of the top half of the casing taken on the line 5—5 of FIG. 3;

FIG. 6 is a cross sectional view of the device taken on the line 6—6 of FIG. 3 looking in the direction of the arrows;

FIG. 7 is a cross sectional view of the device taken on the line 7—7 of FIG. 3 looking in the direction of the arrows;

FIG. 8 is an end view taken from the left of FIG. 2 on substantially the same scale as FIG. 2 showing the device disconnected but with the spark plug in position to be cleaned;

FIG. 9 is an illustration of a spark plug with parts broken away to illustrate the action of the abrasive particulate upon the interior surfaces of the plug; and FIG. 10 is similar illustration of the end view of the spark plug showing the direction of the moving particles of abrasive in relation to the surfaces to be scoured.

DESCRIPTION OF THE PREFERRED EMBODIMENT

Figure 1:
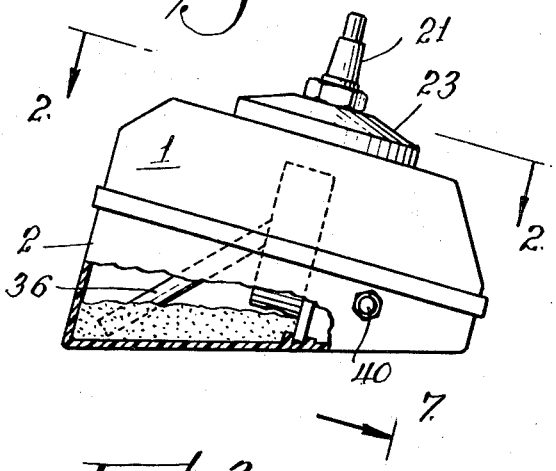
FIG. 1 is a side elevational view of the spark plug cleaner of the present invention with part of the lower casing section broken away to reveal the charge of abrasive particulate and the blower with its intake.
Figure 2:
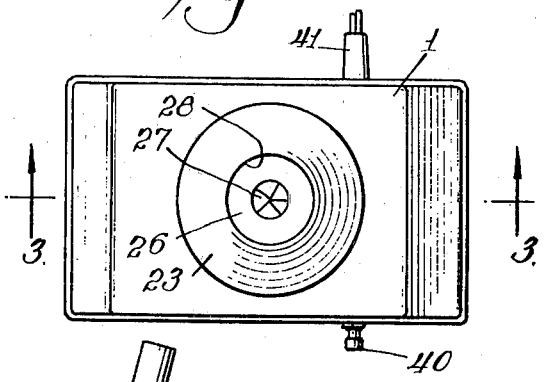
FIG. 2 is a top plan view of the device shown in FIG. 1.

Referring first to FIGS. 1, 2, 3 and 6, the device of the invention comprises a container consisting of the top or cover part 1 and the bottom or base part 2, these parts being telescoped at their margins by a flange 3 on the cover part 1 which, along the central part 4, shown in section in FIG. 7 and indicated by dotted lines in FIG. 5, provides a tongue and groove interlock between the top and bottom parts which are held together by the spring of the material of which these parts are made. Pressure inwardly of the lower walls at the point shown in FIG. 7 and the dotted lines of FIG. 5 will release the tongues 3 from the grooves 4 and permit separation of the parts.

Figure 3:
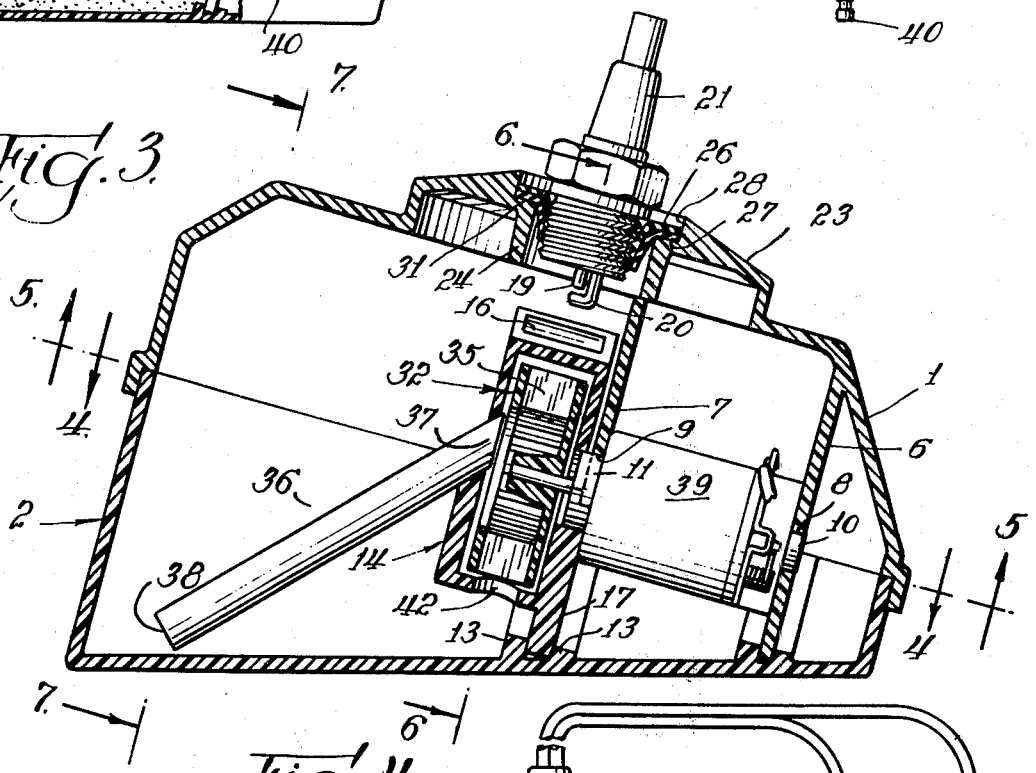
FIG. 3 is a vertical section taken on the line 3—3 of FIG. 2 revealing the location of the spark plug, its mounting, the blower and its intake and discharge and the motor for driving the blower.
Figure 4:
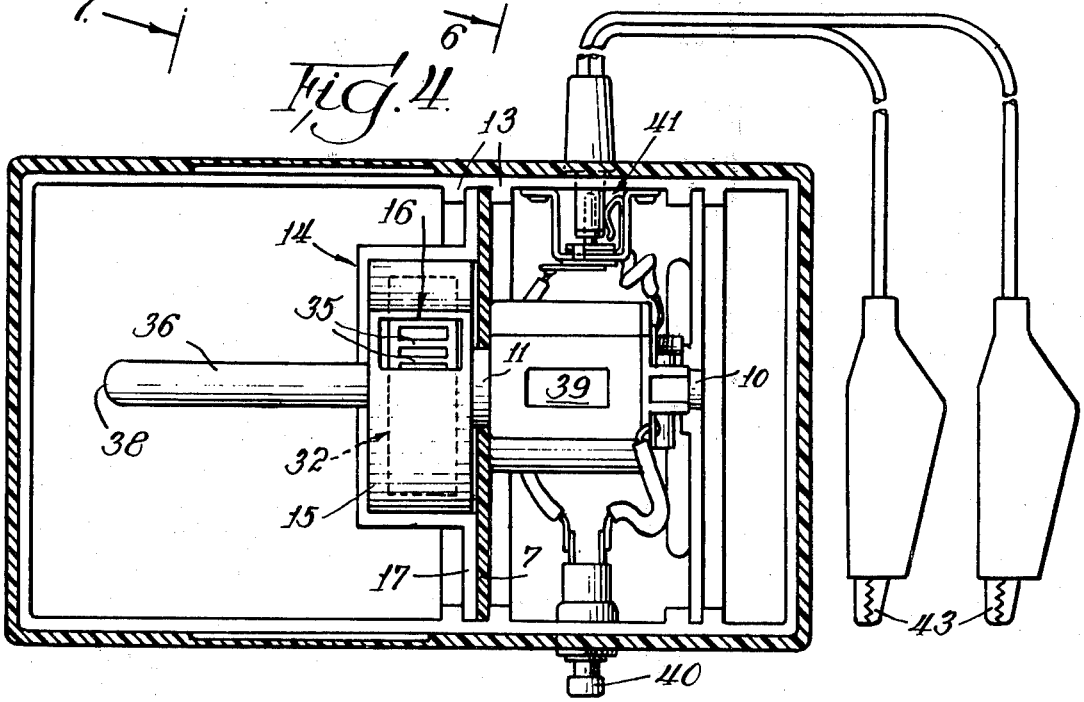
FIG. 4 is a horizontal section taken on the line 4—4 of FIG. 3 looking in the direction of the arrows.

Referring to the upper casing part 1, there are shown in FIG. 5, two transverse walls 6 and 7 providing seats for the free motor bearing 10 and the combination motor and blower fan bearing 11 (see FIGS. 3, 4 and 6). The bottom part 2 of the casing has lateral and bottom ribs 13 extending down along the sides of the lower casing section 2 and along the bottom of the same. A blower casing 14 comprising the flanged circular shell 15 with a tangential outlet 16 has a generally rectangular mounting board 17 which board extends from the upper edge of the lower section 2 at one side to the opposite upper edge of the lower casing section 2 (see FIG. 6).

The blower casing 14 14 is integral with the mounting board 17 which extends across the full width of the bottom section 2. The cylindrical blower shell 15 with the tangential outlet 16 approximates a volute, the discharge of which is indicated by the arrows 18 in FIGS. 6, 9 and 10. This discharge scours the central electrode 19, the transverse electrodes 20, and the procelain insulator 21 by the flow of particles at 18, which flow is in a diagonally upward direction, mainly through the upper quarter of the impeller and adjacent discharge outlet 16, illustrated in FIG. 6. The procelain insulator 21, which contains the central electrode of the spark plug, has its surface exposed to the diagonal upward jet of abrasive particles. By turning the spark plug on its longitudinal axis the diagonal flow 18 of the abrasive particulate is enabled to remove the carbon deposits from the surface of the porcelain insulator and from the metallic electrodes and the interior of the lower end of the spark plug metallic shell.

The top part 1 of the casing has a low hollow boss 23 with a central aperture for receiving the threaded part of a spark plug as illustrated in FIG. 3. The said sleeve 24 joins the top of the hollow boss 23 with a counterbore at the outer end of said sleeve 24 providing a seat or annular shoulder 31 for receiving the peripheral flanges of two overlapping sealing members 26 and 27 which are seated in the recess 28 in the center of the hollow boss 23. Recess 28 terminates in a flat annular shoulder 31 upon which annular shoulder are disposed the two circular elastic seal members 26 and 27. The top member 26 is an elastic washer of approximately 1⅛ inches outer diameter and approximately ½ inch inside diameter seated in the recess 28 of the hollow boss 23, the said washer 26 fits snugly at its outer periphery in the circular recess 28. The recess 28 terminates on an annular shoulder 31 in the hollow boss 23. Between the elastic washer 26 and the annular shoulder 31 there is secured the radially split diaphragm 27. The radial splits extend from the center to approximately the inner circumference of the elastic washer 26. The annular shoulder on the body of the spark plug above the threads of the spark plug engages the washer 26 when the inner end of the spark plug is pushed axially through the elastic annular washer, which washer 27 in gripping the threaded metal sleeve of the spark plug provides a closure tight enough to prevent the passage of the abrasive particles. The split elastic diaphragm which underlies the flat circular washer 26 reforms itself, when the spark plug is withdrawn, into the form of a flat plate, or sheet, as the angular sections spring back into the plane of the concentric surrounding sheet which is circular. This form of sealed mounting permits spark plugs of a range of diameters to be received in sealed relation for cleaning by the present machine. Variation of diameter of the mounting threads of the spark plug is not material. Various sizes are accommodated. Other known forms of self-closing elastic seal may be utilized for this purpose.

The blower impeller 32 is mounted for rotation in the impeller casing 15. The impeller consists of two spaced side plates between which radial blades 35 are mounted. This constitutes a closed impeller with a front central axial opening for intake of air and particulate. The blower casing or shell has an axial inlet opening which communicates with the suction tube 36 which extends through an opening at the center of the blower casing axially of the impeller. The suction tube 36 is disposed substantially in the central vertical plane passing through the axis of the rotor 32. The upward slant of the tube 36 from the lower corner of the storage or receiving chamber takes the particulate by suction directly upwardly diagonally into the delivery stream at the discharge duct 16 (see FIG. 6) and projects the particles against the exposed portion of the spark plug which it is desired to clean. The action is vigorous and highly effective. This avoids the undesirable submergence of the inlet tube if it is allowed to swing sidewise where its intake may be submerged by gravitation of the mass of particulate into such corner of the casing.

The motor 39 has its shaft directly connected to the shaft of the impeller. The terminals of the motor lead through a normally open push switch 40 to a plug and jack connection 41 between the motor terminals and a pair of spring clips 43 which are adapted to make connection with the battery of the vehicle.

As may be seen in FIG. 6, the stream of abrasive particles, thrown by the rotating impeller against the points and interior of the ring being cleaned, comes into the plug at an angle to its longitudinal axis—that is, the axis upon which it is designed to be wobbled and to be rotatable by the operator during cleaning. This is readily accomplished and is highly advantageous since the plug is fully rotatable in the elastic grip of the spark plug holder and may be wobbled to fully expose the interior surfaces to the blast of particulate.

This permits the projected particles to impinge upon a much greater part of the inside surface of the plug as well as the projecting contacts to be cleaned. The porcelain center of the plug from which the central electrode projects can thus be cleaned around its complete periphery. All that is required to accomplish this is for the operator to wobble the plug in its elastic sealing seat while the blower is projecting the stream of particles.

A drain opening 42 in the bottom of the impeller casing avoids accumulation of particulate in the impeller casing which might block starting movement of the impeller and cause burn out of the motor. The loss in blower efficiency is not significant.

In normal use, a charge of particulate is delivered to the compartment containing the blower and its suction tube, the spark plug is inserted in the elastic mounting in the top section of the casing, the casing parts are closed upon each other, the battery terminals 43 are connected, and the push switch 40 is actuated whereupon the motor drives the impeller. It, in turn, draws the granular abrasive from the hopper container 2 and projects it as indicated by the arrows 18 in FIG. 6.

The delivery of the particulate at high velocity, diagonally upward, as indicated in FIGS. 6, 9 and 10, has in conjunction with the turning of the spark plug on its longitudinal axis and wobbling the same in its support, the ability to chip the carbon deposit from the downwardly extending insulator 21, as illustrated in FIG. 9. The diagonal projection of the particulate, relative to the longitudinal axis of the spark plug and the turning of the spark plug on its longitudinal axis by the hand of the operator with the switch 40 closed, performs an effective cleaning job.

The normally open spring biased switch 40 stops the operation of the motor-blower, and this will occur when the operator moves has hand from a position of holding the switch closed to a position of separating the casing parts 1 and 2. There is, therefore, no danger of particulate being wasted or, what is worse, projecting the particulate into the face of the operator. The machine is normally held in the hand of the operator with the right hand thumb on the switch 40. If the operator wishes to open the casing, it is inconvenient for him to keep his thumb on the switch. When the operator rotates or wobbles the spark plug on its axis during the cleaning operation, there is no danger of the particulate abrasive being projected into his face. The particulate and carbon dust may be discarded and a fresh charge of particulate introduced into the casing.

I claim:

1. In a portable spark plug cleaner, an enclosure having an aperture for receiving a spark plug to be cleaned, said aperture including elastic supporting and sealing means for rotatably holding and sealing to the enclosure the spark plug to be cleaned with the spark plug having its electrodes and its supporting central insulator exposed within the enclosure; a centrifugal abrasive particulate projector including an electric motor and a rotary blower driven by said motor for sucking up and projecting a stream of abrasive particulate toward the spark plug and against its electrodes and supporting central insulator, said elastic supporting and sealing means rotatably holding the spark plug to be cleaned with its longitudinal axis at an angle to the direction of projection of said particulate whereby to scour the lateral surface of the central insulator upon wobbling of the spark plug upon said elastic supporting and sealing means; and means within said enclosure for providing continuous circulation of a charge of particulate contained within said enclosure.

2. In a spark plug cleaner, a closed horizontally divided two-section main casing, comprising an upper and a lower section, a charge of abrasive particulate in said main casing, the said casing sections having matching transverse inner partitions forming a transverse upwardly extending wall upon one side of which is mounted a driving motor and upon the other side of which there is mounted a blower driven by said motor, said blower having an impeller and an impeller casing with an intake tube extending diagonally down to a point adjacent the bottom of the main casing and a discharge outlet directed upwardly, said blower having its intake tube extending from the central part of the impeller casing downwardly towards the floor and terminating with its lower end open at said floor, the upper part of the main casing having a spark plug receiving opening in its top wall and a radially expansible radially slotted elastic diaphragm with an overlying elastic washer secured at their outer margins to the casing over said spark plug receiving opening and attached to the casing for holding and sealing the spark plug with its electrodes on the inside of the aforesaid main casing in position to be impinged by the discharge of the blower.

3. In a spark plug cleaner, a closed two-section, horizontally divided outer casing, the casing sections having matching transverse inner vertical partitions forming a transverse wall upon one side of which is mounted a driving motor shaft and upon the other side of which wall there is mounted on said shaft a blower impeller, an impeller casing having a discharge outlet directed diagonally upwardly and having an inclined intake tube extending from the central part of the impeller casing diagonally downward to a point adjacent the junction of the end wall and the floor of the lower part of the outer casing, the upper part of the outer casing having a spark plug receiving opening in its top wall, and a centrally perforated radially expansible and contractible elastic diaphragm secured to the casing to cover said spark plug receiving opening for holding a spark plug with its electrodes on the inside of the aforesaid outer casing and with its longitudinal axis inclined to the vertical.

4. The method of cleaning a spark plug having a metallic mounting shell containing a downwardly extending tapered insulator carrying a central electrode which comprises directing a blast of granular abrasive, at a small angle to the axis of the insulator, upon the central electrode and adjacent surfaces of the spark plug and rotating the spark plug upon its longitudinal axis during the projection of said blast of abrasive.

5. The method of cleaning a spark plug having a metallic mounting shell containing a downwardly extending tapered insulator carrying a central electrode which comprises directing a blast of granular abrasive, at a small angle to the axis of the insulator, upon the central electrode and adjacent surfaces of the spark plug and wobbling the open end of the spark plug relative to the impinging blast of particulate for exposing the lateral surfaces of the spark plug insulator to the blast of particulate.

6. In a portable self-contained spark plug cleaner, a casing comprising a top casing section (1) and a bottom casing section (2) separable on a substantially inclined plane, vertically registering transverse dividing walls, one in each casing section dividing the space within the enclosure transversely into two adjacent compartments, namely a motor compartment and a blower compartment, a driving motor (39) supported on the transverse wall (7–17), in the motor compartment, and having a motor shaft projecting into the blower compartment, an impeller (32) mounted on said motor shaft, an impeller housing (14) attached to said transverse wall, said impeller housing having a tangential discharge outlet (16) directed diagonally upward, said impeller housing having a central inlet opening and an inclined suction tube (36) having its upper end mounted in communication with the central inlet opening of the impeller housing, and its lower end extending to substantially the level of the floor of said blower compartment, the upper casing section (1) having a top wall (23) with a circular opening having an annular seat (31), a centrally radially split circular elastic sealing diaphragm (27) having its outer edges disposed on said annular seat (31), and a flat elastic washer (26) mounted in said annular recess on top of the margin of said split diaphragm (27), the discharge outlet (16) of the impeller casing (14) being directed diagonally upwardly to direct particulate discharged by said impeller, to strike the electrode bearing end of a spark plug held on said sealing set (26, 28).

7. A portable spark plug cleaner adapted to be held in the hand of the user, comprising the combination of a closed generally rectangular oblong hollow box-like container consisting of two parts, namely a top part and a bottom part, said parts being engageable with each other on a substantially horizontal plane, a transverse partition adjacent one end of the container, said partition comprising an upper partition wall part disposed in the upper casing part and a lower partition wall part disposed in the lower casing part in register with the upper wall part, said wall parts dividing the space in said container into a motor compartment and a blower compartment, a driving motor mounted in said motor compartment adjacent said partition and being disposed in said motor compartment, said motor having an armature shaft extending from the motor into the blower compartment, a particulate blower having a casing mounted in the bottom part of the container remote from the motor and having a bladed impeller connected to the motor shaft to be driven thereby, said blower casing having an axial inlet, said inlet being disposed above the floor of the blower compartment and an upwardly directed tangential discharge outlet of said blower casing, there being a substantially unencumbered floor space in the blower compartment between the outer end wall of the blower compartment and the said axial inlet of the blower casing, the top part of the container having an aperture above the discharge outlet of the blower casing, a flexible sealing ring secured in an opening in the top part of the casing in line with the discharge of particulate by said blower and forming an opening into which a spark plug to be cleaned may be mounted and seated to reveal its electrodes and the end of their insulation to the inside of the impeller compartment in line with the discharge from the impeller housing, and a suction tube connected and its upper end to the central inlet opening of the impeller housing and inclined down to the floor of the impeller compartment for raising particulate from the floor of the impeller compartment into the central inlet opening of the impeller housing, the flow of air and particulate through said suction tube being discharged from the blower in line with the exposed end of a spark plug when it is held in said spark plug holder.

8. The combination of claim 7, wherein the spark plug holder in the upper wall of the upper casing part comprises a circular opening having an enlarged annular counterbore providing an inwardly radially extending shoulder, a circular sealing diaphragm of elastic material having its outer margins seated on said annular shoulder and having a series of radial slits, of an odd number, extending from the center towards but short of the outer margins thereof, and a flat resilient washer mounted in said annular counterbore upon the outer margin of said sealing diaphragm, the said spark plug holder being disposed in line with the discharge of particulate from the blower.

* * * * *

Disclaimer 4,062,155.—*Roy A. Fricke,* River Forest, Ill. SPARK PLUG CLEANER. Patent dated Dec. 13, 1977. Disclaimer filed Dec. 19, 1980, by the assignee, *Roy A. Fricke.*

Hereby enters this disclaimer to claims 1, 4 and 5 of said patent.

[*Official Gazette April 14, 1981.*]